United States Patent [19]

Moore et al.

[11] Patent Number: 4,485,741

[45] Date of Patent: Dec. 4, 1984

[54] BOOSTER CONTAINER WITH ISOLATED AND OPEN CORD TUNNELS

[75] Inventors: Jack M. Moore; Michael T. Sutch, both of Benson, Ariz.

[73] Assignee: Apache Powder Company, Benson, Ariz.

[21] Appl. No.: 484,726

[22] Filed: Apr. 13, 1983

[51] Int. Cl.[3] ..... F42D 3/00

[52] U.S. Cl. ..... 102/331; 102/314; 102/317; 102/321; 102/332; 102/275.7; 102/275.12

[58] Field of Search ..... 102/314, 317, 321, 331, 102/332, 275.7, 275.12

[56] References Cited

U.S. PATENT DOCUMENTS

| | | | |
|---|---|---|---|
| 3,183,836 | 5/1965 | Griffith | 102/331 |
| 3,420,173 | 1/1969 | Slawinski et al. | 102/331 X |
| 3,431,851 | 3/1969 | Kern et al. | 102/331 X |
| 4,015,526 | 4/1977 | Bond et al. | 102/331 X |
| 4,023,494 | 5/1977 | Barton et al. | 102/314 |
| 4,037,536 | 7/1977 | Griffith | 102/331 |
| 4,141,296 | 2/1979 | Calder, Jr. et al. | 102/332 |
| 4,178,852 | 12/1979 | Smith et al. | 102/331 X |
| 4,334,476 | 6/1982 | Day et al. | 102/331 X |

*Primary Examiner*—Peter A. Nelson

*Attorney, Agent, or Firm*—Townsend & Townsend

[57] ABSTRACT

A booster container is used to hold a primary charge useful for detonating cap insensitive explosives, such as ammonium nitrate. The container includes a pair of cord tunnels which may be used in various combinations to detonate the primary charge with either an electric blasting cap or a detonating cord. The container is also useful for holding non-electric blasting caps and transfer tubes in place as the booster container is lowered into the bore hole.

5 Claims, 6 Drawing Figures

BOOSTER CONTAINER WITH ISOLATED AND OPEN CORD TUNNELS

BACKGROUND OF THE INVENTION

1. Field of the Invention

The present invention relates generally to containers for packaged explosives, and more particularly to a container useful for holding explosive boosters employed in downhole blasting.

2. Description of the Prior Art

In blasting, and particularly in downhole blasting, relatively insensitive explosives or blasting agents such as ammonium nitrate-fuel oil compositions, are detonated by booster or primer charges containing more sensitive explosive material which can be detonated by ordinary blasting caps and/or detonating cords. Heretofore, most such booster charges have comprised cast high explosives, such as trinitrotoluene (TNT) or pentaerythritol tetranitrate (PETN), melted and poured into a vessel. Such a vessel can be lowered to the bottom of a bore hole, and the blasting agent layered on top of it.

In many cases, it is desirable to place two or more charges of blasting agent at various elevations in the bore hole. To accomplish such layering (commonly referred to as "decking") it is necessary to separate the layers of blasting agent by intermediate layers of earth, rock, sand or other inert material. Such separation allows a short delay between the detonation of the various layers of explosives, which delay is desirable to achieve certain blasting patterns.

When layering or decking explosives, it is necessary that each separate charge of blasting agent have its own booster or primer charge for detonation. Then, by providing means for detonating the booster charges with a predetermined time delay between successive charges, the desired blasting sequence can be achieved.

Such isolated detonation can most easily be achieved by providing separate electric blasting caps for each level of blasting agent. An electric blasting cap is inserted into the booster, and the booster then lowered into the bore hole by means of the connecting electric cable. Separate blasting caps and cables are provided for each booster, and each booster in turn can be electrically detonated with any time delay desired. While electric blasting caps have the advantage of precise timing, the use of multiple cables complicates the detonation procedure. Moreover, electric blasting caps can be prematurely detonated by thunderstorms, stray electric current, static electricity, and RF energy. For these reasons, many users prefer non-electric detonation techniques.

Virtually all nonelectric detonation of booster charges is achieved using detonating cords which include an explosive core material, typically PETN, wherein the cord is initiated at the surface of the bore hole and rapidly propagates down into the hole. In the case of a single explosive charge in the hole, the detonating cord can be used to directly detonate the charge simply by inserting the cord into the primer charge. In this way, as soon as the detonation reaches the primer, the primer is detonated.

When multiple layers of explosive charges are to be detonated with time delays between each detonation, it is no longer possible to employ the detonating cord directly. Instead, a "transfer tube" is used to detonate a blasting cap which is inserted into the booster explosive. The transfer tube is typically tied at one end to the detonating cord. As the detonation propagates through the detonating cord and past the transfer tube, the transfer tube and the blasting cap are ignited. The blasting cap includes a delay element so that detonation of the primer charge does not occur for a preselected period.

Heretofore, a number of specialized booster containers have been developed which are capable of operation with delay-type transfer tubes. See, for example, the U.S. Pat. No. 4,178,852 to Smith et al. The explosive device described therein is currently sold by Atlas Powder Company, a subsidiary of Tyler Corporation, Dallas, Tex. 75251. The commercial unit is described in Data Sheet 701 of the Atlas Powder Company. The booster container of Smith et al. is intended to be detonated only by the particular delaying detonator described in the patent. While conventional detonating cord is used to suspend and ignite the booster, the transfer tube must have the particular configuration so that one end will lie adjacent to the detonating cord while the other end will be inserted in the detonator well formed into the container. While this container is functional, it does not allow initiation by electric blasting cap or direct initiation by the detonating cord.

Other specialized booster containers are described in U.S. Pat. Nos. 4,347,789; 4,334,476; 4,282,812; 4,023,494; 3,064,573; and 2,920,523. None of the booster containers described in these patents is useful for all the detonation techniques just described. For example, the downhole delay assembly described in U.S. Pat. No. 4,347,789 would not be useful for direct initiation by a detonating cord.

SUMMARY OF THE INVENTION

The present invention provides a booster container useful for detonating explosive charges placed in vertical bore holes. The explosive in the container is capable of being detonated by a wide variety of detonating systems, including electric blasting caps, detonating cords, and non-electric delay blasting caps.

The booster container includes an elongate receptacle for receiving a primer charge, typically a packaged explosive such as a water gel or emulsion, and a cap for sealing the primer within the receptable. The receptacle is characterized by a pair of cord tunnels located on its exterior surface. The first cord tunnel is an elongate tube which is completely isolated from the interior of the receptacle. The elongate tube is useful for suspending the container on a detonating cord without allowing direct initiation of the primer by said cord. In such case, a transfer tube can be connected to the detonating cord and used to initiate the primer charge, usually with a time delay. The isolated cord tunnel will also be useful when the primer is to be detonated by an electric blasting cap.

The second cord tunnel is open along one edge to the interior of the receptacle. By passing an explosive detonating cord through the open cord tunnel, the primer charge carried inside the receptacle will be directly detonated by the detonating cord. This configuration is useful when no time delay is desired.

DESCRIPTION OF THE SPECIFIC EMBODIMENTS

Figure 1:
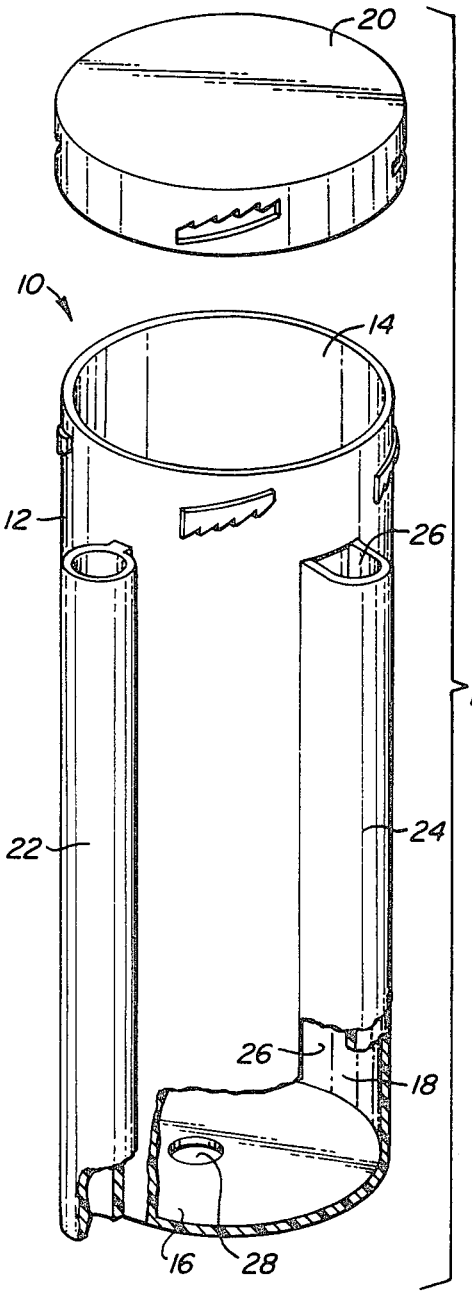
FIG. 1 is an isometric view illustrating the booster container of the present invention with portions broken away.

A booster container 10 employing the design princi- :s of the present invention is illustrated in FIG. 1. The ›oster container comprises an elongate receptacle 12 ving an open top 14 and a closed bottom 16. Thus, the :eptacle 12 defines a receiving cavity 18 for enclosing explosive primer charge (not shown). A cap 20 fas- ıs to the upper end of the receptacle 12 to close the ening 14 after the primer charge has been inserted :o the cavity 18.

The elongate receptacle 12 is characterized by a pair cord tunnels 22 and 24. The first cord tunnel 22 is a ›e attached to the outer surface of the receptacle 12 d generally axially aligned therewith. The length of : cord tunnel 22 will generally be about equal to that the receptacle 12, although its length can be greater less than the length of the receptacle by several :hes without impairing the performance of the con- ner 10. For reasons that will be described later, the ıide diameter of the tunnel 22 should be sufficiently 'ge to receive both a detonating cord and a transfer ›e. Typically, a diameter in the range from about 0.3 0.425 inches will be adequate. In the preferred em- diment, the diameter is about 0.375 inches.

The second cord tunnel 24 is open to the interior of : receptacle 14. A slot 26 is formed in the wall of the :eptacle 12 to provide physical communication be- een the cord tunnel 24 and the interior of the recepta- : 18. Conveniently, the cord tunnel 24 will be formed th a width equal to the width of the slot 26 and will minate in a half-cylinder. The width and radius of the lf-cylinder are chosen to accommodate a detonating rd of up to about 50 grains per foot, requiring a width about 0.225 inches. While the width can be made aller, such a smaller width can interfere with sliding the booster container down the detonating cord.

Conveniently, a hole 28 will be provided in the bot- n 16 of the receptacle 12. The hole 28 should be large ›ugh to accommodate conventional blasting caps, th a diameter of about 0.325 inches being suitable.

The booster container 10 of the present invention will compatible with virtually any type of cap-sensitive ›losive, such as PETN, RDX, TNT, dynamite and o component explosives such as comminuted ammo- ım nitrate and nitromethane. In particular, the oster container is intended for use with prepackaged ›-sensitive water gels and emulsions. Such gels and ıulsions are soft and pliable and typically packaged in ›er or thin plastic, rendering it difficult to insert blast- ; caps and other detonators and maintain them in the ›per location as the booster is lowered down the bore le. Using the booster container of the present inven- n, however, it is possible to suspend the container by :cing the detonating cord or electric blasting cap ›le through one of the two cord tunnels. When ap- ›priate, a blasting cap with or without a time delay ı then be inserted into the explosive through the hole in the bottom. The hole 28 is not absolutely neces- y, however, since the blasting cap could be inserted ough the slot 26. Use of the hole 28, though, is more ıvenient.

Figure 2A:
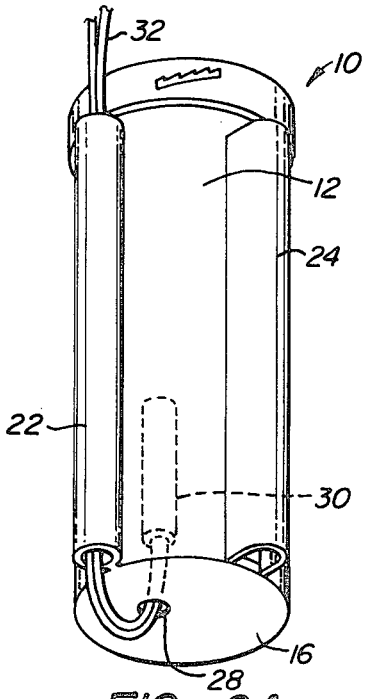
FIGS. 2A–2D illustrate the booster container of the present invention in various detonating configurations.

Referring now to FIGS. 2A–2D, the various configurations for using the booster container 10 of the present invention will be described. FIG. 2A illustrates the use of the booster container 10 with an electric blasting cap 30 inserted into the primer explosive through the hole 28 in the bottom 16 of the receptacle 12. Electric cable 32 runs from the electric blasting cap 30 upward through the isolated cord tunnel 22. The cable 32 can thus be used to lower the booster container 10 into the bore hole and, once the container 10 is in place, can be used to electrically detonate the charge therein. It should be noted that in the configuration of FIG. 2A, each booster container 10 lowered into a bore hole will require a separate electric cable 32.

Figure 2B:
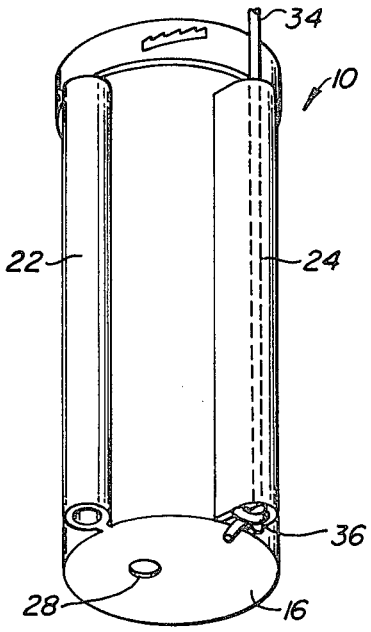

The use of the booster container 10 with a detonating cord 34 is illustrated in FIG. 2B. As illustrated, the cord 34 is directed through the open cord tunnel 24 and tied in a knot 36 at its lower end. In this manner, the detonating cord 34 can be used to support and lower the booster container 10 to the desired depth in a bore hole. Since the detonating cord 34 is exposed directly to the primer charge in cavity 18 of the receptacle 12, the primary charge will be detonated as soon as detonation of the cord 34 propagates to the open cord tunnel 24. Thus, the configuration of 2B will not be useful when it is desired to provide delayed detonation.

Figure 2C:
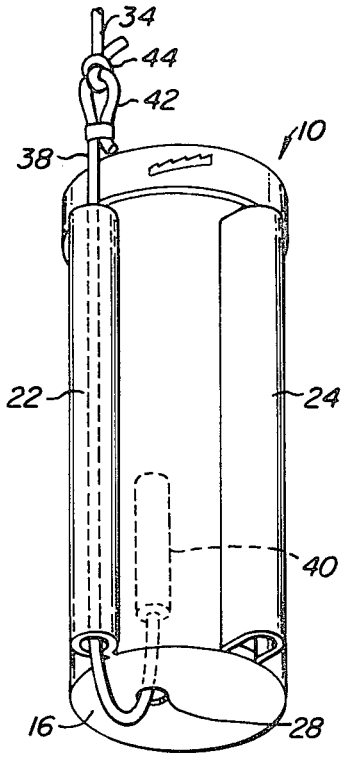
Figure 2D:
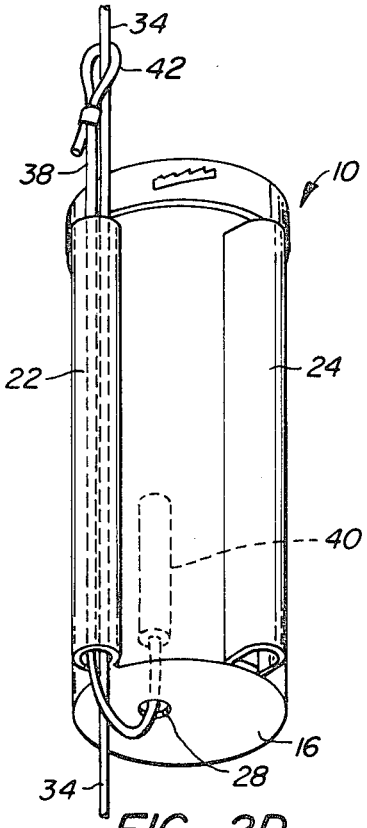

Delayed detonation can be achieved as illustrated in either FIG. 2C or 2D. The configuration of FIG. 2C will be employed when a time delay is desired at the bottom-most booster container on the detonating cord 34. Instead of running the detonating cord 34 through the open cord tunnel 24, the detonating cord is connected to a transfer tube 38 which runs through the isolated cord tunnel 22. The transfer tube 38 terminates in a blasting cap 40 having a built-in delay which will typically range from about 25 to 400 milliseconds, or more. Transfer tubes usable in this configuration are available under the tradename Nonel Primadet available from Blasting Products Division of the Ensign Bickford Company, Simsbury, Conn. 06070.

One end of the transfer tube 38 will usually terminate in a loop 42 which allows the detonating cord 34 to be physically attached, typically by tying a knot 44. The transfer tube 38 contains a compound which deflagrates when initiated by detonating cord 34. This deflagration is energetic enough to initiate the delay element of blasting cap 40 but too low in energy to directly initiate the primer charge by itself.

The transfer tube 38 may also be employed when layering or decking explosives at two or more levels in the bore hole. This configuration is illustrated in FIG. 2D. Again, the transfer tube 38 is directed through the isolated cord tunnel 22 and the blasting cap 40 inserted into the primer charge through the hole 28. In contrast with configuration of FIG. 2C, the detonating cord 34 also passes through the isolated cord tunnel 22 and the loop 42. The transfer tube 38 will be activated as soon as the detonation of the detonating cord 34 reaches the loop 42. The detonation follows cord 34 downward and is able to detonate additional primer charges attached to cord 34 elsewhere. In this way, a multiple decking configuration, as illustrated in FIG. 3, can be achieved.

Figure 3:
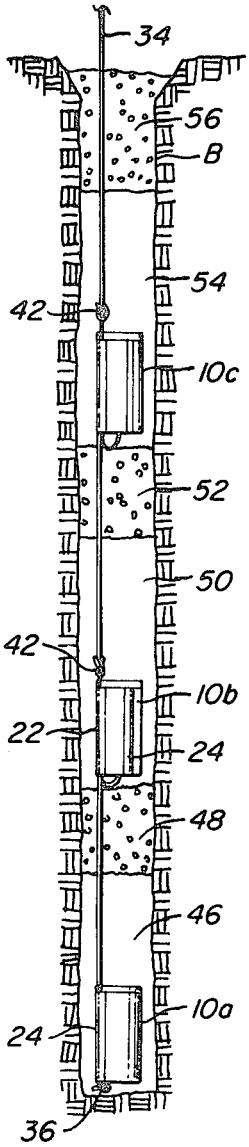
FIG. 3 illustrates a typical arrangement where the ›oster container of the present invention is used for :tonating multiple layers of explosives in a vertical ›re hole with time delay.

Referring now to FIG. 3, a typical blasting scheme employing the booster containers 10 of the present invention is illustrated. A bore hole B is drilled into the ground to a desired depth. A first booster container **10*a* is attached to the detonating cord 34 as illustrated in either FIG. 2B or 2C. Typically, the bottom-most charge will not be delayed, and the configuration of FIG. 2B employed. This is the configuration illustrated in FIG. 3. After the booster container 10***a* is tied on to the detonating cord 34, it may be lowered to the bottom of the bore hole B. Once it is in place, the desired blasting agent, such as ammonium nitrate-fuel oil, can be poured into the hole so that it is layered generally above the blasting container 10*a*. The layer of blasting agent is indicated by reference numeral 46. In order to isolate blasting agent 46 from subsequent layers of blasting agent, an intermediate layer of earth, rock, sand or the like is next poured into the hole. The depth of the inert material will depend on the necessary distance for isolation, the number of explosive charges being placed, and the like. This layer is indicated at reference numeral 48.

Next booster container 10*b* is attached to the detonating cord 34 as illustrated in FIG. 2D. The booster container may then be dropped into the bore hole so that it slides down the detonating cord 34 until it reaches the "bottom" defined by the upper surface of layer 48. The desired blasting agent is then introduced into the hole (layer 50) and a second intermediate layer of inert material (layer 52) is added.

A third blasting container 10*c* can then be lowered on the detonating cord 34 as just described for blasting container 10*b*. A third layer 54 of blasting agent is poured into the hole, and finally, the hole is topped off with inert material 56. Additional layers of blasting agent, of course, can be added, either by reducing the spacing between adjacent layers and/or drilling the bore hole B to a greater depth. Moreover, the blasting container of configuration 2A could be used by employing three separate electric cables 32. Finally, the configuration of FIG. 2C could be used for the lowermost blasting container 10*a*, but usually this will be unnecessary since the bottom explosive charge will be the first to be detonated.

Although the foregoing invention has been described in some detail by way of illustration and example, for purposes of clarity and understanding, it will be obvious that certain changes and modifications may be practiced within the scope of the appended claims.

We claim:

1. A container for holding packaged explosives, said container consisting essentially of:

an elongate receptacle having a continuous side wall, a closed bottom, and an open top, wherein said side wall is characterized by:

(1) an isolated cord tunnel comprising a first elongate tube attached to the outer surface of the receptacle and substantially axially aligned with the receptacle, wherein the interior of said first tube and said receptacle are physically isolated to prevent propagation of explosion by a detonator cord received therethrough; and (2) an open cord tunnel comprising a second elongate tube open at both ends and attached to the outer surface of the receptacle and substantially axially aligned with the receptacle, wherein the interior of said second tube and the interior of said receptacle are open to each other at substantially all points where they adjoin to allow propagation of explosion by a detonator cord received therethrough; and a cap for closing the open top of the receptacle.

2. A container as in claim 1, wherein the closed bottom of the receptacle has a hole therethrough for receiving a blasting cap.

3. A container as in claim 1, wherein the open cord tunnel is formed as an integral part of the side wall of the receptacle.

4. A container as in claim 1, wherein said isolated cord tunnel and said open cord tunnel are separated by an arc of at least 45 degrees.

5. A container as in claim 1, wherein said isolated cord tunnel and said open cord tunnel are adjacent each other.

* * * * *